US006863642B2

(12) United States Patent
Lamont

(10) Patent No.: US 6,863,642 B2
(45) Date of Patent: Mar. 8, 2005

(54) TRUNK ROTATION APPARATUS

(76) Inventor: Gordon Lamont, 5205-62 Street, Lloydminster, Alberta (CA), T9V 2E3

( * ) Notice: Subject to any disclaimer, the term of this patent is extended or adjusted under 35 U.S.C. 154(b) by 259 days.

(21) Appl. No.: 10/083,821

(22) Filed: Feb. 27, 2002

(65) Prior Publication Data

US 2002/0142897 A1 Oct. 3, 2002

(30) Foreign Application Priority Data

Mar. 28, 2001 (CA) ..... 2342795

(51) Int. Cl.[7] ..... A63B 21/00
(52) U.S. Cl. ..... 482/123; 482/91; 482/907
(58) Field of Search ..... 472/33, 38, 19, 472/118, 14, 18; 482/56, 69, 907, 129, 91, 54, 52, 145–147

(56) References Cited

U.S. PATENT DOCUMENTS 1,585,748 A * 5/1926 Wendelken
3,384,369 A * 5/1968 Rumell
3,936,047 A * 2/1976 Brandt et al.
5,149,174 A 9/1992 Charash ..... 297/423
5,558,606 A 9/1996 Poncini et al. ..... 482/79
5,813,947 A 9/1998 Densmore ..... 482/51
5,885,190 A 3/1999 Reiter ..... 482/69
6,572,483 B1 * 6/2003 Hoffman ..... 472/118

FOREIGN PATENT DOCUMENTS

CA 74397 6/1994
CA 82241 10/1997

OTHER PUBLICATIONS

Muscles Alive by John V. Basmajian, Fourth Edition, 1979, Chapter 13, p. 281–193.
Muscles Alive by John V. Basmajian, Fourth Edition, 1979, Chapter 9, p. 175–185.

* cited by examiner

*Primary Examiner*—Jerome W. Donnelly
(74) *Attorney, Agent, or Firm*—Davis & Bujold, P.L.L.C.

(57) ABSTRACT

A trunk rotation apparatus includes a support, a gripping bar and a mounting for mounting the gripping bar to the support for translation movement. This trunk rotation apparatus is suitable for exercising, strengthening or controlled rehabilitative movement.

13 Claims, 7 Drawing Sheets

TRUNK ROTATION APPARATUS

FIELD OF THE INVENTION

The present invention relates to a trunk rotation apparatus used for exercising, strengthening or controlled rehabilitative movement.

BACKGROUND OF THE INVENTION

Workers employed in physical labour and workers employed in sedentary labour both have need of a trunk rotation apparatus. Those involved in physical labour require the trunk rotation apparatus for controlled rehabilitative movement to recover from the effects of over exertion or injury. Those involved in sedentary labour require the trunk rotation apparatus to exercise their trunk to recover from the effects of prolonged inactivity.

SUMMARY OF THE INVENTION

The present invention relates to a trunk rotation apparatus suitable for both exercising, strengthening or controlled rehabilitative movement.

According to the present invention there is provided a trunk rotation apparatus which includes a support, a gripping bar and a mounting for mounting the gripping bar to the support for translation movement.

The trunk rotation apparatus, as described above enables a basic trunk gyration movement to be performed while maintaining one's feet on the floor.

Although beneficial results may be obtained through the use of the trunk rotation apparatus, as described above, a greater variety of movements may be performed when the mounting includes a universal joint permitting pivotal movement about a first substantially horizontal axis and pivotal movement about a second substantially horizontal axis, the second horizontal axis being substantially perpendicular to the first horizontal axis. This provides simultaneous translation movement through two planes.

Although beneficial results may be obtained through the use of the trunk rotation apparatus, as described above, the configuration of gripping bar that is preferred is arcuate with a first end, a second end and a central mounting point equidistant between the first end and the second end. The a arcuate gripping bar is oriented relative to the support to position the first end and the second end farther away from the support than is the central mounting point.

Although beneficial results may be obtained through the use of the trunk rotation apparatus, as described above, the preferred form of support is adapted to support the trunk rotation apparatus from above. It is preferred that the support be made so that it expands and contracts to raise or lower the gripping bar which adjusts the distance of the gripping bar relative to an underlying floor upon which a person making the movements must stand. One possible support configuration includes a peripheral mounting, a hub, and several arms (preferably three) securing the hub to the peripheral mounting. This configuration can be made to expand and contract by providing arms that are telescopically extendible.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
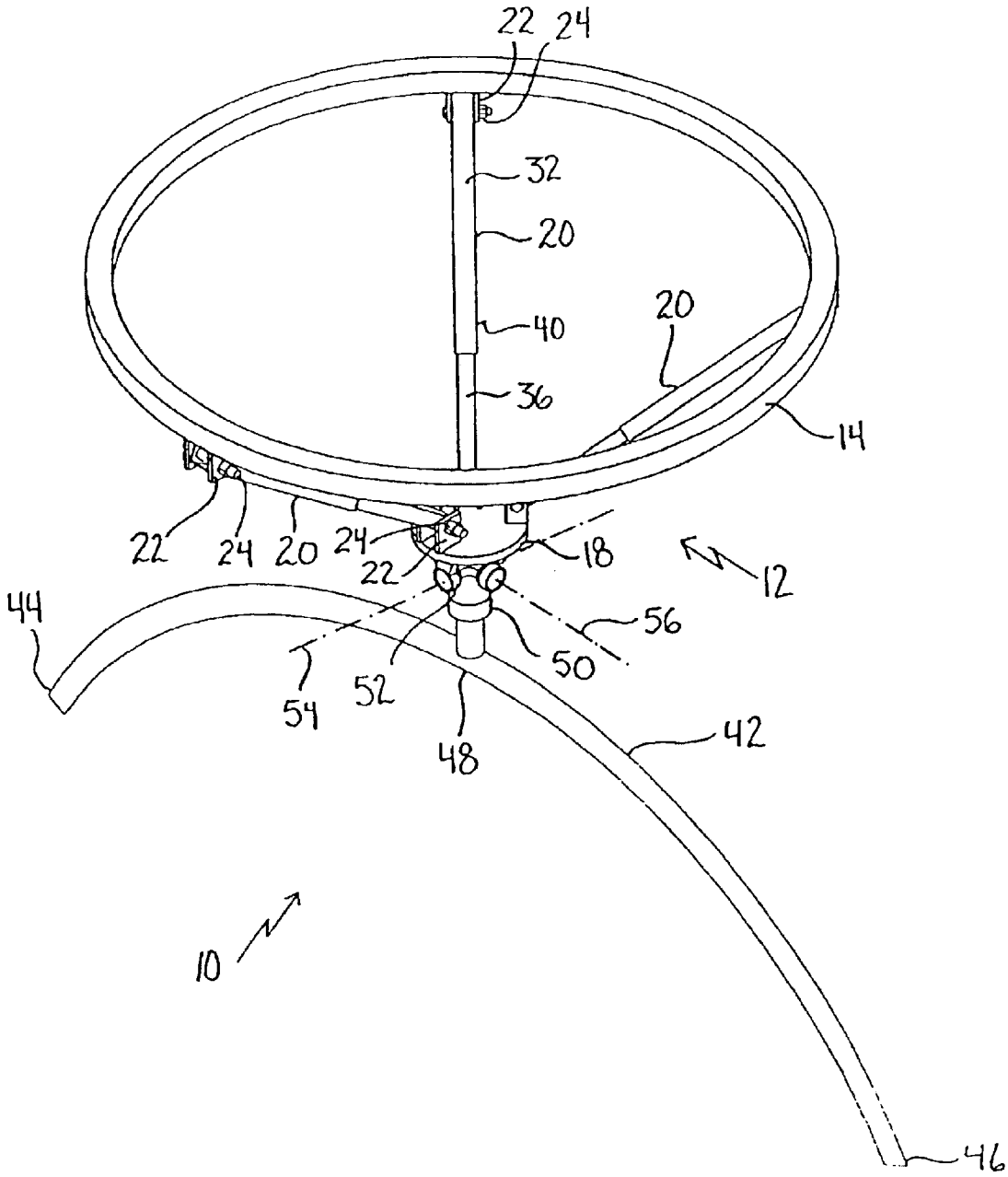
FIG. 1 is a perspective view of a trunk rotation apparatus constructed in accordance with the teachings of the present invention.

The preferred embodiment, a trunk rotation apparatus generally identified by reference numeral 10, will now be described with reference to FIGS. 1 through 7C.

Figure 2:
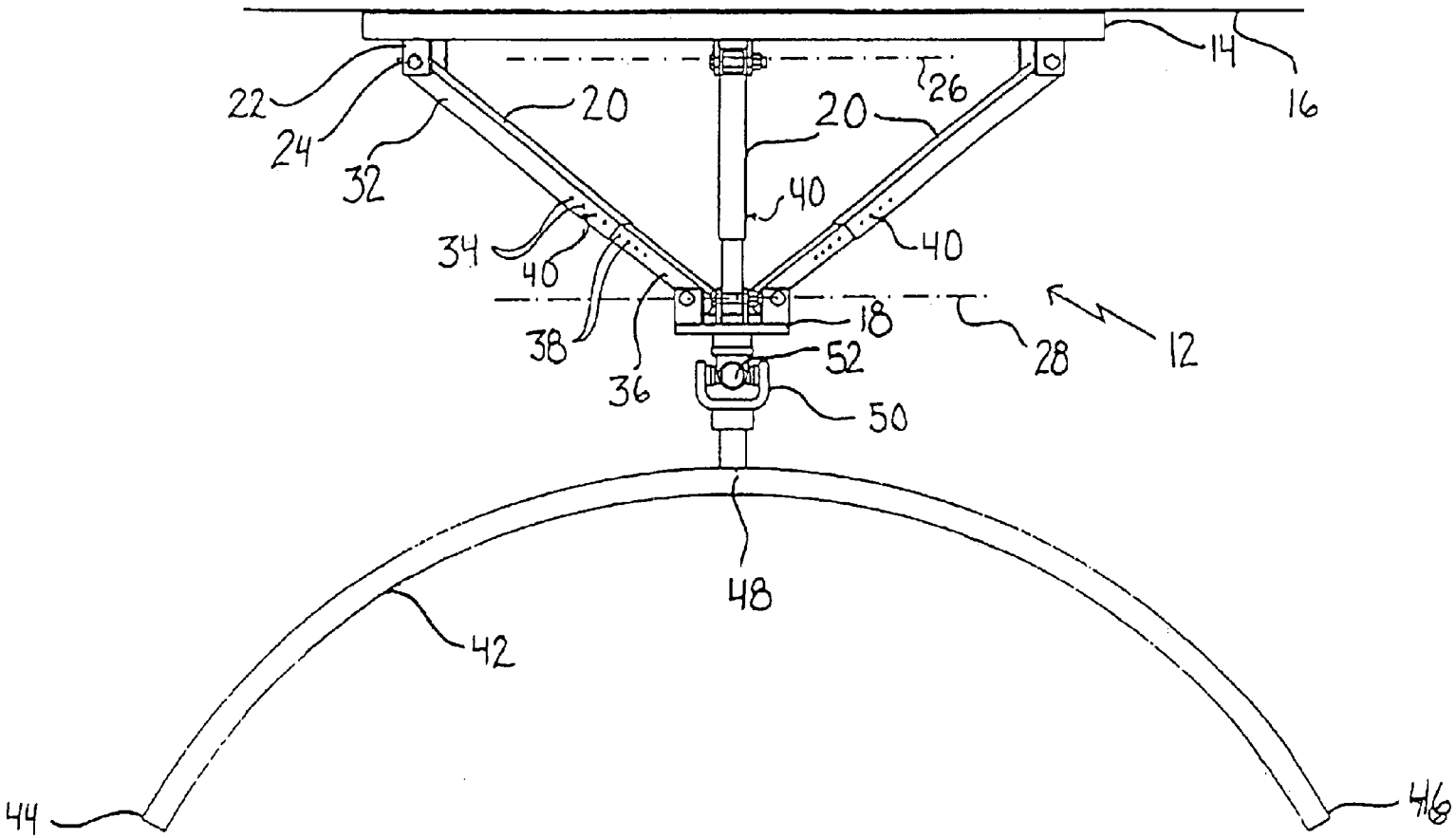
FIG. 2 is a side elevation view of the trunk rotation apparatus illustrated in FIG. 1.
Figure 3:
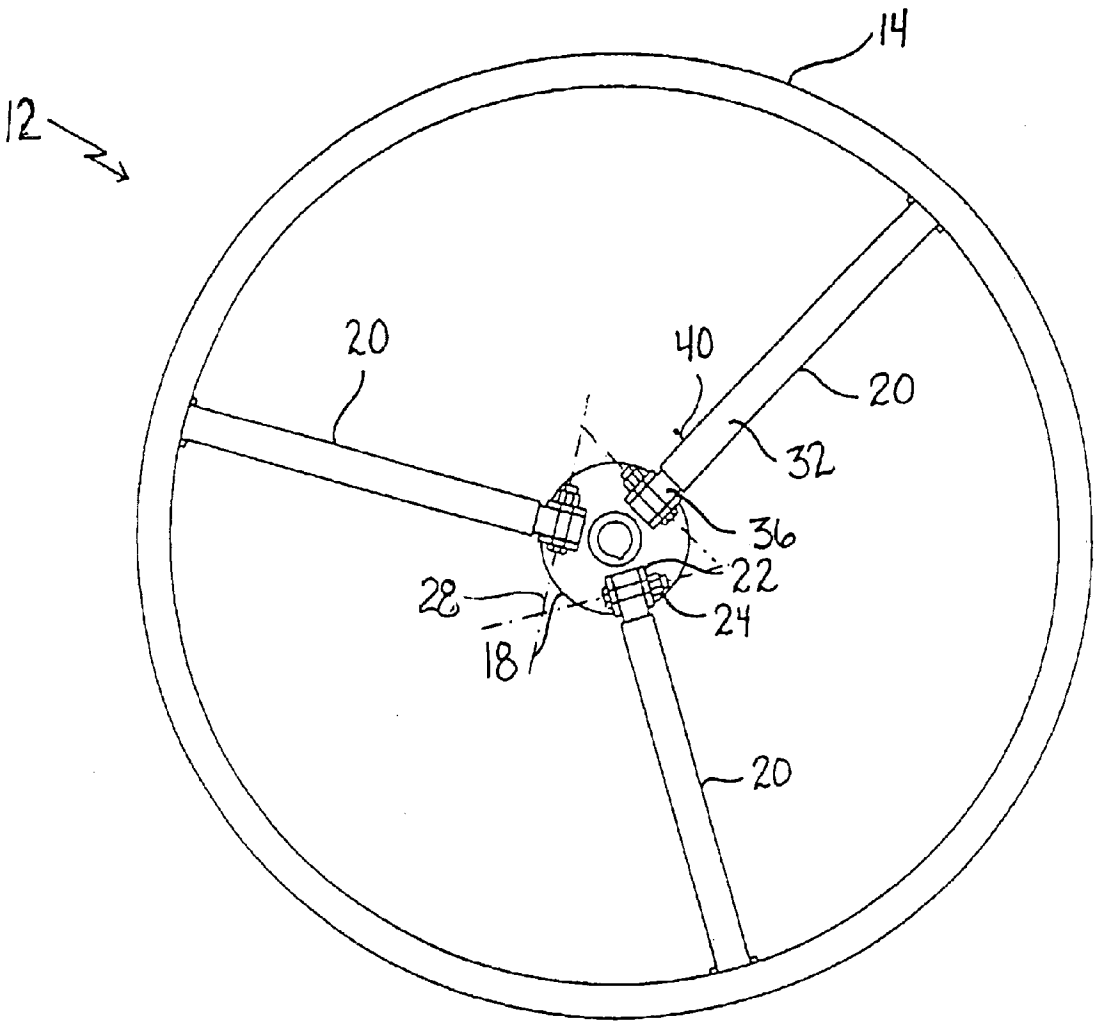
FIG. 3 is a top plan view of the trunk rotation apparatus illustrated in FIG. 1, without the gripping bar.
Figure 4:
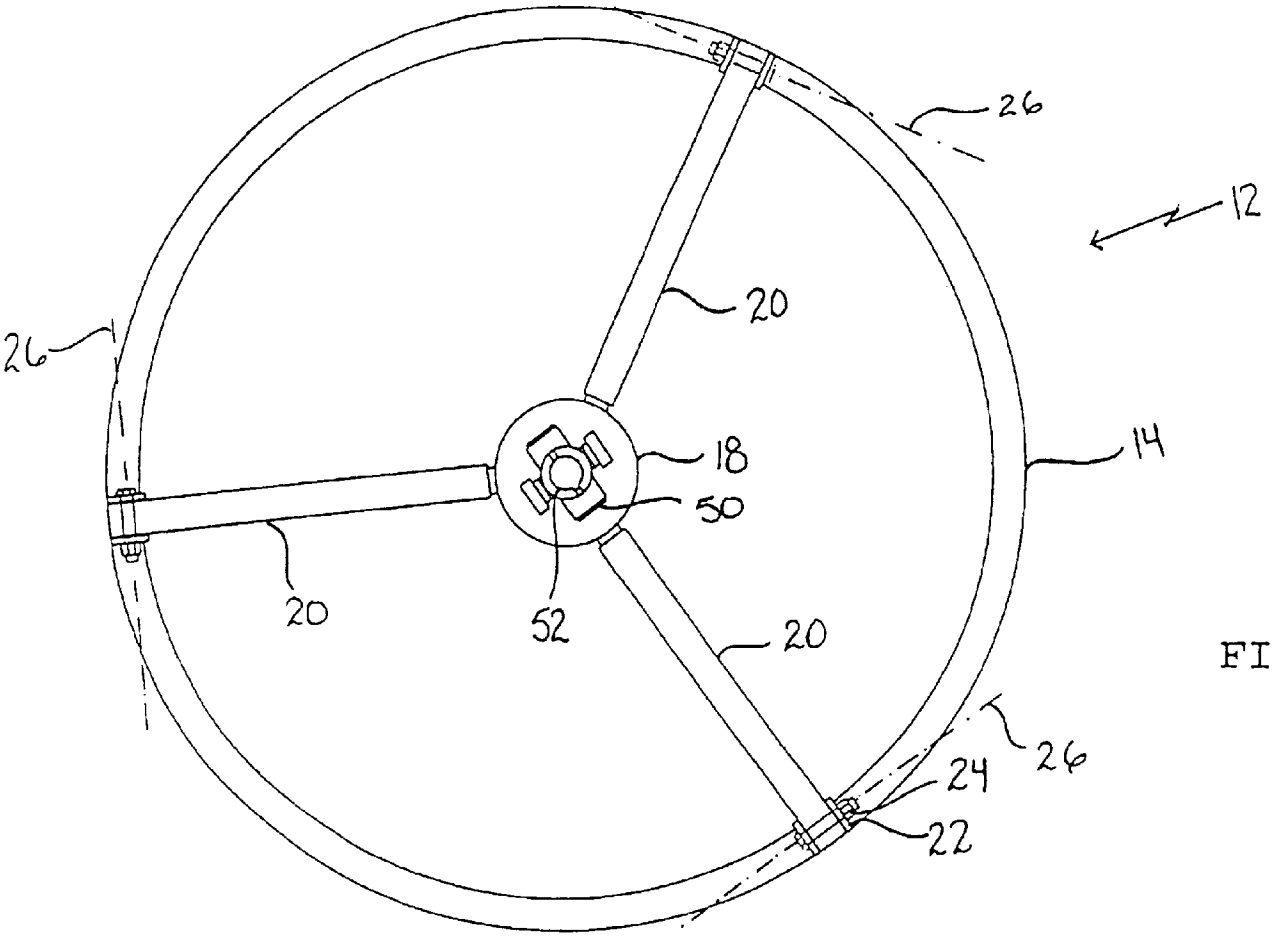
FIG. 4 is a bottom plan view of the trunk rotation apparatus illustrated in FIG. 1, without the gripping bar.

Structure and Relationship of Parts:

Referring to FIG. 1, trunk rotation apparatus 10 includes a support 12 with a peripheral mounting ring 14. Referring to FIG. 2, mounting ring 14 is adapted for mounting to an overhead structure, such as a ceiling 16. Referring to FIG. 1, support 12 also includes a stationary depending hub 18, and three arms 20. Referring to FIG. 2, arms 20 are pivotally mounted by means of brackets 22 and bolts 24 for movement about a substantially horizontal axis 26 to peripheral mounting ring 14 and pivotally mounted for movement about a substantially horizonal axis 28 to hub 18, thereby securing hub 18 to peripheral mounting ring 14. Each of arms 20 are telescopically extendible whereby support 12 can expand and contract to permit the height of hub 18 to be adjusted relative to an underlying floor 30. Each of arms 20 have a first portion 32 with a first series of transverse apertures 34 and a second portion 36 with a second series of transverse apertures 38. First portion 32 telescopically mates with the second portion 36. A locking pin 40 extends through one of first series of apertures 34 and one of second series of apertures 38 to lock arm 20 in a selected telescopic position.

Referring to FIG. 1, an arcuate gripping bar 42 is mounted to support 12. Gripping bar 42 has a first end 44, a second end 46 and a central mounting point 48 equidistant silt between first end 44 and second end 46. Arcuate gripping bar 42 is oriented relative to support 12 to position first end 44 and second end 46 farther away from support 12 than central mounting point 48.

A mounting 50 is provided for mounting gripping bar 42 to hub 18 of support 12 for translation movement. In the illustrated embodiment, mounting 50 includes a universal joint 52 that permits pivotal movement about a first substantially horizontal axis 54 and pivotal movement about a second substantially horizontal axis 56. Second horizontal axis 56 is substantially perpendicular to first horizontal axis 54. Universal joint 52 allows simultaneous translation movement about both axis 54 and axis 56.

Operation:

The use and operation of trunk rotation apparatus 10 will now be described with reference to FIGS. 1 through 7C. Referring to FIG. 2, trunk rotation apparatus 10 can be installed on ceiling 16 using mounting ring 14 as described above, however it will be appreciated that other forms of support could also be used depending how and where trunk rotation apparatus 10 is intended to be installed. For example, trunk rotation apparatus 10 could be supported by an support arm extending from a wall or between open joists.

Once installed, support 12 can be expanded or contracted, as described above, to lower and raise gripping bar 42 to suit the height of a user 58. Once securely installed and adjusted, trunk rotation apparatus 10 is suitable for exercising, strengthening or for controlled rehabilitative movements. In order to use trunk rotation apparatus 10, user 58 would grip gripping bar 42. User 58 can position his or her hands 60 at any position along gripping bar 42, as long as hands 60 are spaced equidistant from central mounting point 48. This may involve placing hands 60 close together or spread as far apart as possible with one hand 60 at first end 44 of gripping bar 42 and other hand 60 on second end 46 of gripping bar 42. By changing the positioning of their hands 60, user 58 changes the location of the resultant load taken by the back 62 and trunk 64. User 58 positions his or her body 66 in preparation for movement. This positioning need not be in vertical alignment with overhead trunk rotation device 10. In preparation for movement, user 58 may stand with feet 68 together or feet 68 apart. User 58 may stand off center by being forward or backward from vertical alignment. The various starting positions for hands 60, feet 68 and body 66 provide a wide range of load options for back 62 and trunk 64. There are also a variety of possible motions. Hereinafter, some of the motions will be described in order to demonstrate the utility of the device 10. It will be appreciated, however, that there are many other motions and exercises possible with trunk rotation apparatus 10.

Figure 5A:
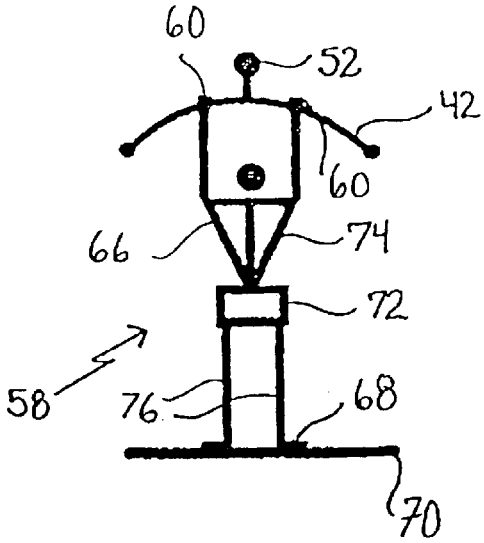
FIGS. 5A through 5C are rear elevation views of the trunk rotation apparatus illustrated in FIG. 1, showing a movement being performed that involves gyration about ones spinal column while maintaining one's feet on the floor.
Figure 5B:
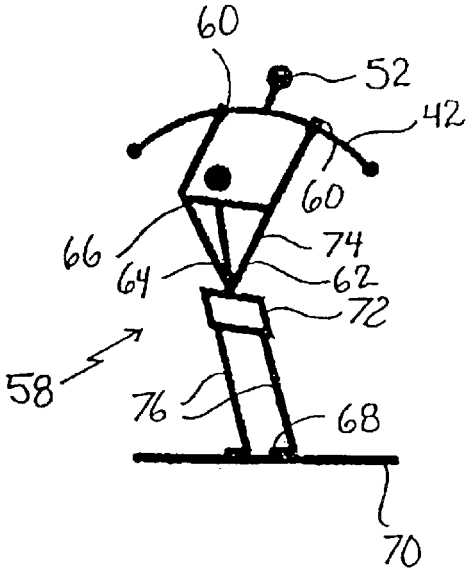
Figure 5C:
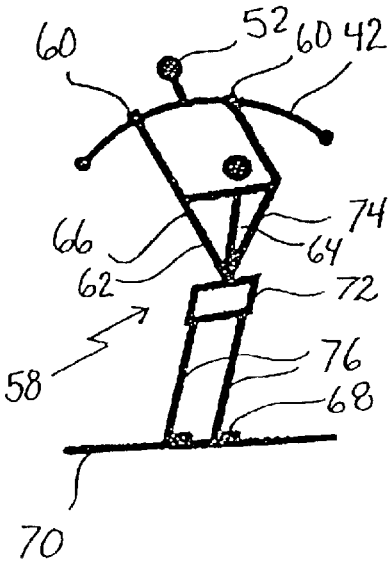

Referring to FIGS. 5A through 5C, for one type of exercise, user 58 would place his feet 68 securely on an underlying surface 70 such as a floor as illustrated in FIG. 5A. Referring to FIGS. 5B and 5C, user 58 would then rotate his lower torso 72 in a circular path, with his upper torso 74 rotating in the same direction. During this exercise, user 58 is supporting a substantial portion his weight by holding onto gripping bar 42. Because gripping bar 42 is mounted on hub 18 and universal joint 52, gripping bar 42 will simultaneously translate through the sagittal plane and the frontal plane.

Figure 6A:
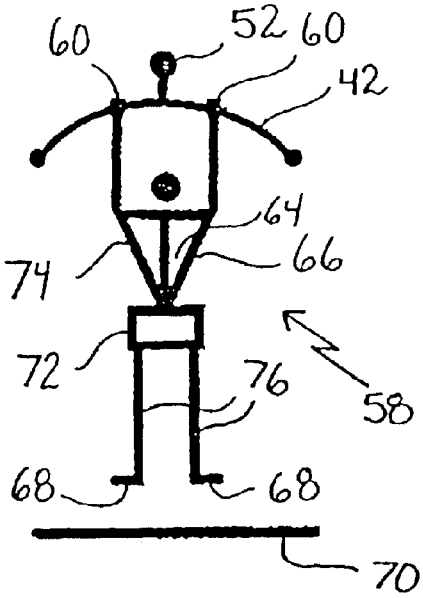
FIGS. 6A through 6C are rear elevation views of the trunk rotation apparatus illustrated in FIG. 1, showing a movement being performed that involves a fully body pendulum movement with one's feet lifted off the floor.
Figure 6B:
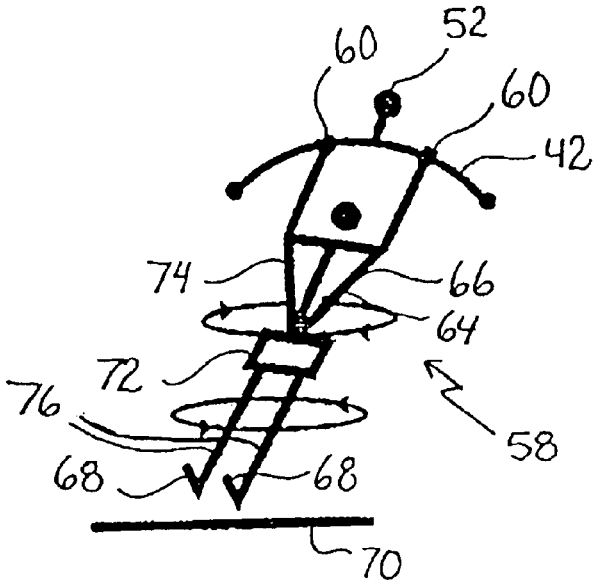
Figure 6C:
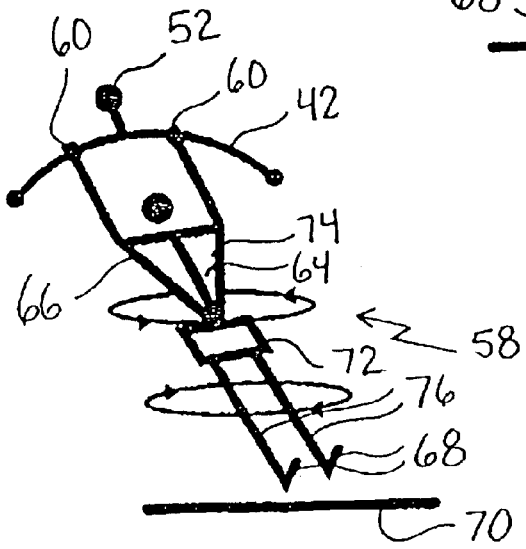

Referring to FIGS. 6A through 6C, a further exercise involves user's 58 weight being fully supported by gripping bar 42 and user 58 suspended above floor 70 with feet 68 swinging freely as illustrated in FIG. 6A. Referring to FIGS. 6B and 6C, using his own momentum, user 58 is able to swing his lower torso 72 or upper torso 74 along with his legs 76. As described above, universal joint 52 accommodates the translation movements of user 58.

Figure 7A:
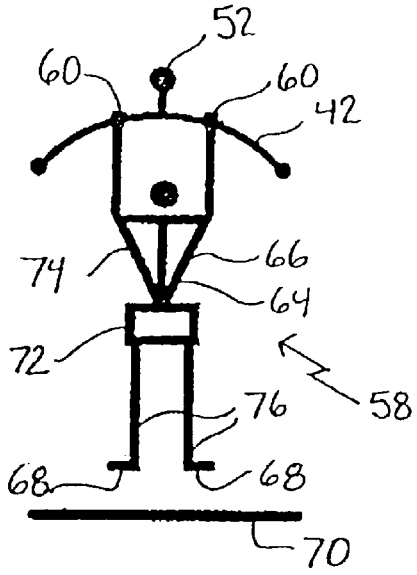
FIGS. 7A through 7C are rear elevation views of the trunk rotation apparatus illustrated in FIG. 1, showing a movement being performed that involves gyration about ones trunk with one's feet lifted off the floor.
Figure 7B:
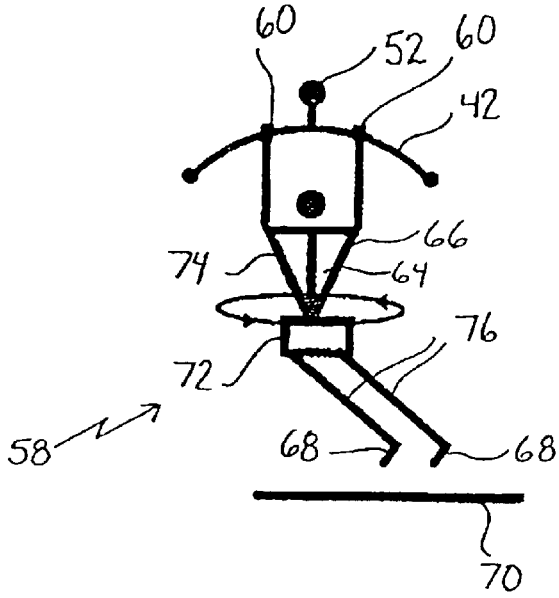
Figure 7C:
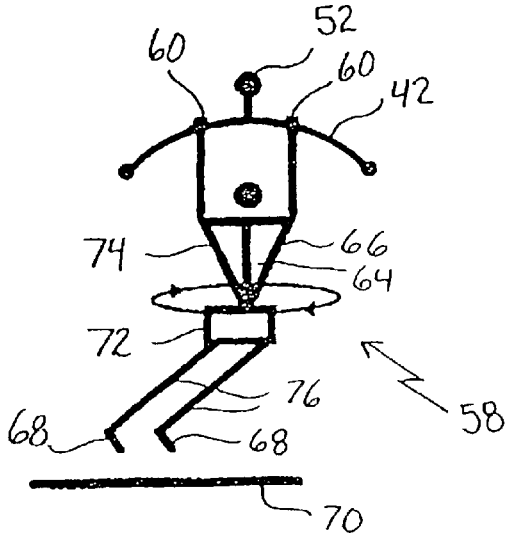

Referring to FIGS. 7A through 7C, a final exercise also involves user's 58 weight being fully supported by gripping bar 42 with user 58 hanging above floor 70 as illustrated in FIG. 7A. Referring to FIGS. 7B and 7C, using his own momentum, user 58 swings his legs 76 a circular path. This works his lower torso 72 while keeping his upper torso 74 relatively still. As previously described universal joint 52 accommodates the translation movements of the user 58.

A controlled stretching can also be performed by employing a "one side" pull to stretch first one and then the other side of the torso. This is accomplished by positioning the users hands asymmetrically on the gripping bar 42, with one hand close to central mounting point 48 and the other hand close to first end 44 or second end 46.

In this patent document, the word "comprising" is used in its non-limiting sense to mean that items following the word are included, but items not specifically mentioned are not excluded. A reference to an element by the indefinite article "a" does not exclude the possibility that, more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A trunk rotation apparatus, comprising:

a support;

a gripping bar;

a mounting for mounting the gripping bar to the support for translation movement; and the support being capable of expanding and contracting to lower and raise the gripping bar, thereby adjusting a height of the gripping bar to suit a user.

2. The trunk rotation apparatus as defined in claim 1, wherein the mounting includes a universal joint permitting pivotal movement of the gripping bar about a first substantially horizontal axis and pivotal movement about a second substantially horizontal axis, the second horizontal axis being substantially perpendicular to the first horizontal axis, thereby simultaneous translation through two planes.

3. The trunk rotation apparatus as defined in claim 1, wherein the gripping bar is arcuate with a first end, a second end and a central mounting point equidistant between the first end and the second end, the arcuate gripping bar being oriented relative to the support to position the first end and the second and farther away from the support than is the central mounting point.

4. The trunk rotation apparatus as defined in claim 1, wherein the support is adapted for mounting to an overhead structure.

5. The trunk rotation apparatus as defined in claim 1, wherein the support includes a peripheral mounting, a hub, and several arms securing the hub to the peripheral mounting.

6. The trunk rotation apparatus as defined in claim 5, wherein each of the several arms are telescopically extendible.

7. The trunk rotation apparatus as defined in claim 5, wherein there are three arms.

8. A trunk rotation apparatus, comprising:

a support;

a gripping bar;

a mounting for mounting the gripping bar to the support for translation movement, including a universal joint permitting pivotal movement about a first substantially horizontal axis and pivotal movement about a second substantially horizontal axis, the second horizontal axis being substantially perpendicular to the first horizontal axis, and the entire universal joint, including the first horizontal axis and the second horizontal axis being disposed above the gripping bar.

9. The trunk rotation apparatus as defined in claim 8, wherein the gripping bar is arcuate with a first end, a second end and a central mounting point equidistant between the first end and the second end, the arcuate gripping bar being oriented relative to the support to position the first end and the second end farther away from the support than is the central mounting point.

10. The trunk rotation apparatus as defined in claim 8, wherein the support includes a peripheral mounting ring adapted for mounting to an overhead structure, a depending hub supporting the mounting for the gripping bay, and three arms pivotally mounted for movement about a substantially horizontal axis to the peripheral mounting ring and pivotally mounted for movement about a substantially horizonal axis to the hub, thereby securing the hub to the peripheral mounting ring, ach of the arms being telescopically extendible, wherein the support expands and contracts to raise and lower the gripping bar, means being provided to lock the arms in a selected telescopic position.

11. The trunk rotation apparatus as defined in claim 10, wherein each of the arms has a first portion and a second portion, the first portion telescopically mating with the second portion, a means being provided to lock the first portion and the second portion in a selected telescopic position.

12. The trunk rotation apparatus as defined in claim 10, wherein the first portion has a first series of transverse apertures and the second portion has a second series of transverse apertures, a locking pin extending through a selected one of the first series of apertures and a selected one of the second series of apertures to lock the first portion and the second portion in a selected telescopic position.

13. A trunk rotation apparatus, comprising:

a support including a peripheral mounting ring adapted for mounting to an overhead structure, a depending hub, and three arms pivotally mounted for movement about a substantially horizontal axis to the peripheral mounting ring and pivotally mounted for movement about a substantially horizonal axis to the hub, thereby securing the hub to the peripheral mounting ring, each of the arms being telescopically extendible, wherein the support expands and contracts to raise ard lower the hub, thereby permitting a height of the gripping bar to be adjusted relative to an underlying floor, each of the arms having a first portion with a first series of transverse apertures and a second portion with a second series of transverse apertures, the first portion telescopically mating with the second portion, a locking pin extending through a selected one of the first series of apertures and a selected one of the second series of apertures to lock the arm in a selected telescopic position;

an arcuate gripping bar a fixed distance from the support, the gripping bar having a first end, a second end and a central mounting point equidistant between the first end and the second end, the arcuate gripping bar being oriented relative to the support to position the first end and the second and farther away from the support than the central mounting point;

a mounting for mounting the gripping bar to the hub of the support for translation movement, including a universal joint permitting pivotal movement about a first substantially horizontal axis and pivotal movement about a second substantially horizontal axis, the second horizontal axis being substantially perpendicular to the first horizontal axis.

* * * * *